United States Patent [19]

Walker

[11] Patent Number: 4,635,726

[45] Date of Patent: Jan. 13, 1987

[54] METHOD FOR CONTROLLING LOST CIRCULATION OF DRILLING FLUIDS WITH WATER ABSORBENT POLYMERS

[75] Inventor: Clarence O. Walker, Richmond, Tex.

[73] Assignee: Texaco Inc., White Plains, N.Y.

[21] Appl. No.: 738,000

[22] Filed: May 28, 1985

[51] Int. Cl.[4] ..... E21B 33/138

[52] U.S. Cl. ..... 166/294; 166/295; 175/72; 252/8.512

[58] Field of Search ..... 166/294, 295, 282, 283; 175/72; 252/8.5 LC; 523/130

[56] References Cited

U.S. PATENT DOCUMENTS

| | | | |
|---|---|---|---|
| 2,890,169 | 6/1959 | Prokop | 252/8.5 |
| 3,078,920 | 2/1963 | Brink . | |
| 3,082,823 | 3/1963 | Hower . | |
| 3,288,230 | 11/1966 | Braunlich, Jr. et al. | 175/72 X |
| 3,448,800 | 6/1967 | Parker et al. | 166/294 |
| 3,818,998 | 6/1974 | Hessert | 175/72 |
| 3,909,421 | 9/1975 | Gaddis | 252/8.55 |
| 3,926,891 | 12/1975 | Gross et al. | 523/111 X |
| 3,997,484 | 12/1976 | Weaver et al. | 523/132 X |
| 4,124,748 | 11/1978 | Fajimoto et al. | 526/8 |
| 4,128,528 | 12/1978 | Frisque et al. | 260/42.55 |
| 4,182,417 | 1/1980 | McDonald et al. | 166/295 |
| 4,190,562 | 2/1980 | Westerman | 523/111 X |
| 4,261,422 | 4/1981 | White et al. | 166/305 |
| 4,276,935 | 7/1981 | Hessert et al. | 166/295 |
| 4,320,040 | 3/1982 | Fujita et al. | 524/459 |
| 4,328,864 | 5/1982 | Friedman | 166/295 X |
| 4,391,925 | 7/1983 | Mintz et al. | 523/130 |
| 4,412,586 | 11/1983 | Sifferman | 166/294 |
| 4,424,247 | 1/1984 | Erickson | 428/402 X |
| 4,442,241 | 4/1984 | Drake et al. | 523/130 |
| 4,445,576 | 5/1984 | Drake et al. | 166/291 |
| 4,475,594 | 10/1984 | Drake et al. | 166/294 |
| 4,498,995 | 2/1985 | Gockel | 252/8.5 |
| 4,503,170 | 3/1985 | Drake et al. | 523/130 |
| 4,526,240 | 7/1985 | McKinley et al. | 175/72 |

*Primary Examiner*—George A. Suchfield

*Attorney, Agent, or Firm*—Jack H. Park; Kenneth R. Priem; Harold J. Delhommer

[57] ABSTRACT

The invention is a method for reducing lost circulation of aqueous or oil based drilling fluids wherein one or more water absorbent polymers are dispersed in a hydrocarbon fluid which is injected into the lost circulation zone. The hydrocarbon carrier fluid initially prevents water from contacting the water absorbent polymer until such water contact is desired. Once the hydrocarbon slug containing the polymer is properly placed at the lost circulation zone, water is mixed with the hydrocarbon slug so that the polymer will expand with the absorbed water and substantially increase in size to close off the lost circulation zone.

3 Claims, No Drawings

METHOD FOR CONTROLLING LOST CIRCULATION OF DRILLING FLUIDS WITH WATER ABSORBENT POLYMERS

BACKGROUND OF THE INVENTION

This invention is related to concurrently filed U.S. patent applications Ser. No. 737,992, filed May 28, 1985, Ser. No. 737,990, filed May 28, 1985, and Ser. No. 737,991, filed May 28, 1985.

The invention concerns a method for reducing lost circulation when aqueous or oil based drilling fluids are used. More particularly, the method involves dispersing a water absorbent and hydrocarbon repellent polymer in a hydrocarbon fluid, which will prevent the polymer from absorbing water and expanding to plug fissures and thief zones until water absorption is desired.

Drilling fluids, or drilling muds as they are sometimes called, are slurries of clay solids used in the drilling of wells in the earth for the purpose of recovering hydrocarbons and other fluid materials. Drilling fluids have a number of functions, the most important of which are: lubricating the drilling tool and drill pipe which carries the tool, removing formation cuttings from the well, counterbalancing formation pressures to prevent the inflow of gas, oil or water from permeable rocks which may be encountered at various levels as drilling continues, and holding the cuttings in suspension in the event of a shutdown in the drilling and pumping of the drilling fluid.

For a drilling fluid to perform these functions and allow drilling to continue, the drilling fluid must stay in the borehole. Frequently, undesirable formation conditions are encountered in which substantial amounts or, in some cases, practically all of the drilling fluid may be lost to the formation. Drilling fluid can leave the borehole through large or small fissures or fractures in the formation or through a highly porous rock matrix surrounding the borehole.

Most wells are drilled with the intent of forming a filter cake of varying thickness on the sides of the borehole. The primary purpose of the filter cake is to reduce the large losses of drilling fluid to the surrounding formation. Unfortunately, formation conditions are frequently encountered which may result in unacceptable losses of drilling fluid to the surrounding formation despite the type of drilling fluid employed and filter cake created.

A variety of different substances are now pumped down well bores in attempts to reduce the large losses of drilling fluid to fractures and the like in the surrounding formation. Different forms of cellulose are the preferred materials employed. Some substances which have been pumped into well bores to control lost circulation are: almond hulls, walnut hulls, bagasse, dried tumbleweed, paper, coarse and fine mica, and even pieces of rubber tires. These and other prior art additives are described in U.S. Pat. No. 4,498,995.

Another process that is employed to close off large lost circulation problems is referred to in the art as gunk squeeze. In the gunk squeeze process, a quantity of a powdered bentonite is mixed in diesel oil and pumped down the well bore. Water injection follows the bentonite and diesel oil. If mixed well, the water and bentonite will harden to form a gunky semi-solid mess, which will reduce lost circulation. Problems frequently occur in trying to adequately mix the bentonite and water in the well. The bentonite must also be kept dry until it reaches the desired point in the well. This method is disclosed in U.S. Pat. No. 3,082,823.

Many of the methods devised to control lost circulation involve the use of a water expandable clay such as bentonite which may be mixed with another ingredient to form a viscous paste or cement. U.S. Pat. No. 2,890,169 discloses a lost circulation fluid made by forming a slurry of bentonite and cement in oil. The slurry is mixed with a surfactant and water to form a composition comprising a water-in-oil emulsion having bentonite and cement dispersed in the continuous oil phase. As this composition is pumped down the wellbore, the oil expands and flocculates the bentonite which, under the right conditions, forms a filter cake on the wellbore surface in the lost circulation area. Hopefully, the filter cake will break the emulsion causing the emulsified water to react with the cement to form a solid coating on the filter cake. But such a complex process can easily go wrong.

U.S. Pat. No. 3,448,800 discloses another lost circulation method wherein a water soluble polymer is slurried in a nonaqueous medium and injected into a well. An aqueous slurry of a mineral material such as barite, cement or plaster of paris is subsequently injected into the well to mix with the first slurry to form a cementlike plug in the wellbore.

U.S. Pat. No. 4,261,422 describes the use of an expandable clay such as bentonite or montmorillonite which is dispersed in a liquid hydrocarbon for injection into the well. After injection, the bentonite or montmorillonite will expand upon contact with water in the formation. Thus, it is hoped that the expanding clay will close off water producing intervals but not harm oil producing intervals.

A similar method is disclosed in U.S. Pat. No. 3,078,920 which uses a solution of polymerized methacrylate dissolved in a nonaqueous solvent such as acetic acid, acetic anhydride, propionic acid and liquid aliphatic ketones such as acetone and methyl-ethyl ketone. The methacrylate will expand upon contact with formation water in the water producing intervals of the well.

It has also been proposed to mix bentonite with water in the presence of a water soluble polymer which will flocculate and congeal the clay to form a much stronger and stiffer cementlike plug than will form if bentonite is mixed with water. U.S. Pat. No. 3,909,421 discloses such a fluid made by blending a dry powdered polyacrylamide with bentonite followed by mixing the powder blend with water. U.S. Pat. No. 4,128,528 claims a powdered bentonite/polyacrylamide thickening composition prepared by mixing a water-in-oil emulsion with bentonite to form a powdered composition which rapidly becomes a viscous stiff material when mixed with water. U.S. Pat. Nos. 4,503,170; 4,475,594; 4,445,576; 4,442,241 and 4,391,925 teach the use of a water expandable clay dispersed in the oily phase of a water-in-oil emulsion containing a surfactant to stabilize the emulsion and a polymer dispersed in the aqueous phase. When the emulsion is sheared, it breaks and a bentonite paste is formed which hardens into a cementlike plug. The patent discloses the use of such polymers as polyacrylamide, polyethylene oxide and copolymers of acrylamide and acrylic or methacrylic acid.

U.S. Pat. No. 4,124,748 discloses a cross-linked copolymer of a vinyl ester and an ethylenically unsaturated carboxylic acid or derivative thereof that can absorb 200–800% of its weight in water and expand substantially in volume when doing so. Another highly water absorbent, expanding copolymer is described in U.S. Pat. No. 4,320,040. The described compound is derived by polymerizing acrylic acid and/or methacrylic acid in the presence of polyvinyl alcohol followed by neutralization and heat treatment.

SUMMARY OF INVENTION

The invention is a novel method for reducing lost circulation when aqueous or oil based drilling fluids are used. It involves the use of one or more water absorbent and preferably, hydrocarbon repellent polymers dispersed in a hydrocarbon carrier fluid which are injected into the wellbore and lost circulation zone. The hydrocarbon carrier fluid initially prevents water from contacting the water absorbent polymer until such water contact is desired. Once the hydrocarbon slug containing the polymer is properly placed at the lost circulation zone, water is mixed with the hydrocarbon slug so that the polymer will expand with the absorbed water and substantially increase in size to close off the lost circulation zone.

The hydrocarbon slug containing a dispersed water absorbent polymer is injected into the wellbore and spotted at the lost circulation zone. Preferably, a slug of water is injected to mix with the hydrocarbon fluid and come into contact with the water absorbent and hydrocarbon repellent polymer. Alternately, aqueous drilling fluid can be mixed with the hydrocarbon slug and the polymer in the lost circulation zone. A final step is circulating the drilling fluid or otherwise removing undesired compounds from the borehole.

DETAILED DESCRIPTION

Drilling fluids are formulated to intentionally plug porous formations during drilling in order to stabilize the borehole and to control fluid loss. However, formations are frequently encountered that are so porous as to increase the loss of drilling fluids beyond an acceptable limit despite the use of lost circulation additives. Furthermore, a borehole may penetrate a fracture in the formation through which most of the drilling fluid may be lost.

In order to close off large pores and fractures which drain drilling fluid from the borehole, it is necessary to place the lost circulation material at the proper location and be able to clean up the wellbore after treatment is completed. The present invention offers a method for accomplishing this in a borehole whether the well is being drilled with aqueous drilling fluids or oil based drilling fluids. The invention involves the use of a polymer which is hydrocarbon repellent, and which expands substantially in volume when absorbing water. The hydrocarbon carrier fluid is used to place the polymer at and in the lost circulation zone before the polymer is contacted with water. Water contact results in water absorption by the polymer, causing the polymer to increase significantly in size, blocking off the lost circulation zone. Mixing with water may be brought about by the use of a separate water slug, or if an aqueous drilling fluid is being used, by mixing the drilling fluid with the hydrocarbon slug and the polymer dispersed therein.

Any polymer which will significantly increase in size after water absorption and be hydrocarbon repellent may be dispersed within the hydrocarbon fluid to practice the present invention. A polymer which will absorb hydrocarbons and still be able to increase substantially in size with water absorption after hydrocarbon absorption may also be employed. A class of water absorbent polymers known as superabsorbent polymers perform very well.

Superabsorbent polymers absorb many times their own weight in water, causing the polymer volume to drastically expand. Several of these preferred highly water absorbent polymers are: alkali metal polyacrylates including J-500 and J-550, trademarked sodium polyacrylate polymers sold by Grain Processing Co.; A-100, a trademarked starch graft copolymer of polyacrylic acid and polyacrylamide sold by Grain Processing Co.; A-400, a trademarked polyacrylamidecosodium acrylate sold by Grain Processing Co.; and B-200, a trademarked potassium salt of A-400 sold by Grain Processing Co.

The amount of water these superabsorbent polymer will absorb is astounding. The J-500 polymer will absorb 375 ml of water per gram of J-500 polymer. The A-100 polymer will suck up 140 ml of water per gram of polymer. However, salt water has an adverse effect on water absorption. The addition of 0.4% NaCl to water will decrease the absorption of A-100 to 55 ml of water per gram of A-100 and decrease absorption of J-500 from 375 ml to 100 ml of water per gram of J-500.

Another group of water absorbent polymers which perform well in the invention are prepared by polymerizing one or more of the acids from the group consisting of acrylic acid and methacrylate acid in the presence of polyvinyl alcohol, neutralizing the polymer, and heat treating the polymer at about 50° C. to about 150° C. These polymers may also be cross-linked by carrying out the polymerization in the presence of a cross-linking agent. The hydrophilic gel polymers prepared according to this method are disclosed in U.S. Pat. No. 4,320,040, the disclosure of which is incorporated herein by reference. The same patent also discloses the use of starch-acrylonitrile graft copolymers. All of these polymers expand substantially in size upon water absorption and absorb from two to eight times their weight in water.

Saponified copolymers of a vinyl ester and a compound selected from the group consisting of ethylenically unsaturated carboxylic acids and derivatives of ethylenically unsaturated carboxylic acids may also be employed. U.S. Pat. No. 4,124,748, the disclosure of which is incorporated herein by reference, states that these copolymers may also be cross-linked by polymerizing in the presence of a cross-linking agent. The cross-linking agent may include polyallyl compounds such as diaalyl phthalate, diallyl maleate, diallyl terephthalate, triallyl cyanurate or triallyl phosphate; polyvinyl compounds such as divinyl benzene, N,N'-methylene-bisacrylamide, ethylene glycol diacrylate, ethylene glycol dimethacrylate or glycerine trimethacrylate; allyl acrylate and allyl methacrylate. As the degree of cross-linking is increased with an increase in the amount of cross-linking agent, the water absorbing ability decreases. Thus, only a moderate amount of cross-linking is desired. These polymers increase significantly in size when absorbing as much as ten times their own weight in water. Furthermore, their gel formation ability is stable in a hydrated state for a long period of time.

If the polymer is structurally weak, a substrate may be used to help support the polymer. Of course, other compounds which absorb water and expand in size which are not mentioned herein, may also be used to control lost circulation according to the invention.

The most preferred method of practicing the invention involves the injection of a discrete slug of hydrocarbon fluid into the wellbore, wherein the hydrocarbon slug contains the water absorbent and hydrocarbon repellent polymer in a proportion sufficient to seal off the lost circulation zone upon contact with water. Depending on the polymer and the composition of the hydrocarbon slug, about two to about 250 pounds of water absorbent polymer per barrel, more preferably, about 10 to about 100 pounds of polymer per barrel, can be placed within the hydrocarbon slug.

The hydrocarbon slug with polymer therein is spotted at the lost circulation zone and preferably, forced into the lost circulation zone by pumping. Depending on the character and size of the lost circulation zone, as little as 100 gallons of the hydrocarbon slug and polymer may be needed. Preferably, an additional hydrocarbon slug is employed as a spacer between the polymer slug and the aqueous drilling fluid to insulate the polymer slug from the water and to force the hydrocarbon fluid slug and polymer into the lost circulation zone. Alternately, a water slug, or the aqueous drilling fluid or oil based drilling fluid itself, may be used to force the polymer into the lost circulation zone. If the well is being drilled with an aqueous mud, it is also preferred to employ a hydrocarbon slug without polymer as a spacer before the polymer slug. These spacer slugs will prevent water from mixing with the hydrocarbon slug and expanding the polymer prior to entry of the polymer into the lost circulation zone.

When the water comes into intimate contact with the hydrocarbon slug containing the polymer, the polymer will absorb the water and expand in the formation and borehole, closing off the lost circulation zone. After a brief setting time, the undesired compounds may be circulated out of the borehole. It is a preferred practice to raise the drill stem and bit above the lost circulation zone so that after the lost circulation zone is sealed off, the drill stem and bit can be brought back down to flush and clean the expanded polymer from the wellbore.

If a clay based aqueous drilling mud is used to expand the polymer instead of a clay-free water, the seal provided by the mixture of expanded polymer and clay will be firmer and more permanent than if the polymer alone was present. However, the use of the water expanded polymer without clay is sufficient to seal off most lost circulation zones.

The polymer particles may be sized over a wide range. The size of the passages through the circulating jets in the drill bit is the absolute maximum particle size. However, the polymer should be of a small enough size so as to be able to enter the formation through fissures, small fractures and large pores. A preferred range of particle size is about 0.1 microns to 5 millimeters. The particles should be sized according to the properties of the formation and the lost circulation zone.

If the polymer is set with a clay free water and it is desired to reverse the treatment, it is only necessary to pump salt water into the borehole. Upon contact with salt water the expanded polymer will break up and release most of its absorbed water. The formerly expanded polymer can then be washed out of the formation. The preferred superabsorbent polymers encapsulated for this invention absorb only one-fourth to one-third as much salt water as fresh water when the salt water concentration is 0.4% NaCl. Higher salt concentrations result in even less salt water absorption. Thus, the use of fresh water in expanding the polymer is preferred.

Any hydrocarbon fluid may be employed as a carrier fluid if it will not attack or react with the polymer. Preferred hydrocarbon fluids are crude oil, diesel oil, kerosene, mineral oil, gasoline, naphtha and mixtures thereof. Because of economics, and the fact of availability at any drill site, diesel oil is the most preferred hydrocarbon carrier. Mineral oil is also normally available on site. Crude oil with a low water content may also be used as the hydrocarbon fluid. It is unlikely that the brine in the crude oil would make any significant difference provided the water content of the crude is low. But if a crude containing brine is employed, fresh water should be used to expand the polymer. The fresh water would dilute any brine in the crude enough so that the brine would have an insignificant effect upon the polymer expansion.

It is important not to use too large of an excess of water to expand the polymer. The intent is to get a viscous thick mixture. Excess water will thin the mixture, decreasing its sealing effect.

Usually, it is immediately apparent when a fracture is penetrated by the wellbore. The mud pressure will drop and less drilling fluid will be circulated back to the top of the hole. Large fractures can be responsible for draining off almost all of the drilling fluid. When this occurs, the hydrocarbon slug containing the polymer should be injected into the wellbore and spotted at the lost circulation zone. Then one of several alternative procedures may be followed, with some steps depending upon whether an aqueous drilling fluid or an oil based drilling fluid is being used.

In one method, the hydrocarbon slug and polymer is pumped down the tubing and back up the annulus to the lost circulation zone. This may be done by adding the hydrocarbon and polymer slug to an aqueous drilling fluid so that drilling fluid precedes and follows the hydrocarbon slug. Once the polymer is properly spotted, the annulus is closed off near the surface. This may be accomplished by closing the rams in the blowout preventer. Pumping of the drilling fluid down the tubing string and back up the annulus of the borehole is resumed to force the hydrocarbon slug into the lost circulation zone. If an aqueous drilling fluid is used, this will also cause the drilling fluid to mix with the hydrocarbon slug and polymer in the lost circulation zone, triggering the expansion of the polymer and sealing off of the lost circulation zone.

Another method is to pump the hydrocarbon slug down the tubing string and back up the annulus to the lost circulation zone, while pumping water down the annulus to meet with the hydrocarbon slug at the lost circulation zone. Pressure can be applied to both the water and the hydrocarbon slug to force both fluids into the lost circulation zone, where mixing and polymer expansion will occur. Another method is to spot the hydrocarbon and polymer slug at the lost circulation zone and then inject water through the tubing string directly to the lost circulation zone to mix with the hydrocarbon and polymer slug. Of course, other methods known in the art may also be used to mix water with the hydrocarbon and polymer slug at the location of the lost circulation zone.

The following example will further illustrate the novel lost circulation additive and invention method of the present invention. This example is given by way of illustration and not as a limitation of a scope of the invention. Thus, it should be clearly understood that the invention additive and method may be varied to achieve similar results within the scope of the invention.

EXAMPLE 350 ml of a hydrocarbon and polymer mixture was prepared to a concentration of 175 pounds of A-400 polymer per barrel of diesel oil. 5% of the total volume or 17.5 ml of tap water were mixed with the diesel oil/polymer mix. A putty like material resulted with no fluid properties whatsoever.

Many other variations and modifications may be made in the concepts described above by those skilled in the art without departing from the concepts of the present invention. Accordingly, it should be clearly understood that the concepts in the description are illustrative only and are not intended as limitations on the scope of the invention.

What is claimed is:

1. A method of reducing lost circulation of drilling fluids in a borehole penetrating an underground formation, comprising:

injecting a discrete slug of a hydrocarbon fluid into a borehole, said hydrocarbon fluid having dispersed therein about 10 to about 100 pounds of a water absorbent polymer per barrel of hydrocarbon fluid which expands upon absorbing water;

injecting into the borehole a discrete slug of a hydrocarbon fluid after the hydrocarbon fluid and polymer slug;

injecting into the borehole a slug of water after the hydrocarbon fluid slug;

forcing the hydrocarbon fluid and polymer slug into a lost circulation zone;

mixing the water slug with the hydrocarbon fluid and polymer slug to allow the water absorbent polymer to absorb water and expand in the formation closing off the lost circulation zone; and circulating undesired compounds out of the borehole.

2. A method of reducing lost circulation of aqueous drilling fluids in a borehole penetrating an underground formation, comprising:

adding a discrete slug of a hydrocarbon fluid to an aqueous drilling fluid so that drilling fluid precedes and follows the hydrocarbon fluid slug, said hydrocarbon fluid having dispersed therein a water absorbent polymer which expands upon absorbing water from an aqueous drilling fluid, said polymer dispersed in the hydrocarbon fluid proportions sufficient to seal off a lost circulation zone upon contact with an aqueous drilling fluid;

spotting the hydrocarbon and polymer slug at the lost circulation zone by pumping the hydrocarbon slug and the preceding and following aqueous drilling fluid down a tubing string and back up an annulus of the borehole to the lost circulation zone;

closing off the annulus near the surface;

continuing to pump aqueous drilling fluid down the tubing string to force the hydrocarbon and polymer slug and aqueous drilling fluid into the lost circulation zone where the water in the drilling fluid will contact the water absorbent polymer, causing the water absorbent polymer to expand in the formation and borehole; and circulating undesired compounds out of the borehole.

3. A method of reducing lost circulation of aqueous drilling fluids in a borehole penetrating an underground formation, comprising:

injecting a discrete slug of a hydrocarbon fluid into a borehole, said hydrocarbon fluid having dispersed therein a water absorbent polymer which expands upon absorbing water from aqueous drilling fluids, said polymer dispersed in the hydrocarbon fluid in proportions of sufficient to seal off a lost circulation zone upon contact with an aqueous drilling fluid;

following the hydrocarbon and polymer fluid with the injection of a second hydrocarbon fluid slug;

injecting an aqueous drilling fluid to force the hydrocarbon fluid and polymer slug into a lost circulation zone;

said second hydrocarbon slug being injected between the hydrocarbon fluid and polymer slug and the aqueous drilling fluid to insulate the hydrocarbon fluid and polymer slug from the aqueous drilling fluid until expansion of the polymer is desired;

contacting the hydrocarbon slug and polymer dispersed therein with the aqueous drilling fluid to allow the water absorbent polymer to absorb water from the aqueous drilling fluid and expand in the formation and borehole; and circulating undesired compounds out of the borehole.

* * * * *